US005283939A

United States Patent [19]

Saunders et al.

[11] Patent Number: 5,283,939

[45] Date of Patent: Feb. 8, 1994

[54] METHOD OF ASSEMBLING A VACUUM CLEANER

[75] Inventors: Craig M. Saunders, Rocky River; James J. Kopco, Richmond Heights; Robert O. Wraight, Westlake; Paul D. Stephens, Cleveland Heights; Michael F. Wright, Cuyahoga Falls, all of Ohio

[73] Assignee: Royal Appliance Mfg. Co., Cleveland, Ohio

[21] Appl. No.: 965,359

[22] Filed: Oct. 23, 1992

Related U.S. Application Data

[60] Continuation of Ser. No. 753,717, Sep. 3, 1991, abandoned, which is a division of Ser. No. 464,202, Jan. 12, 1990, Pat. No. 5,093,956.

[51] Int. Cl.[5] ..... B29C 65/58; A47L 9/00

[52] U.S. Cl. ..... 29/453; 29/426.6; 29/463; 15/327.1; 15/351

[58] Field of Search ..... 29/453, 463, 897, 426.6; 15/327.1, 327.2, 344, 350, 351

[56] References Cited

U.S. PATENT DOCUMENTS

| | | | |
|---|---|---|---|
| 3,634,905 | 1/1972 | Boyd | 15/350 |
| 3,766,594 | 10/1973 | Westergren et al. | 15/327.1 |
| 3,967,352 | 7/1976 | Crowe | 29/453 X |
| 4,079,499 | 3/1978 | Clerici Bagozzi | 29/453 |
| 4,366,344 | 12/1982 | Sheehan | 29/453 X |
| 4,597,130 | 7/1986 | Lyman | 15/327.1 |
| 4,799,460 | 1/1989 | Kuhl | 15/344 X |
| 4,948,176 | 8/1990 | Bartholomew | 29/453 X |
| 5,014,388 | 5/1991 | Schiazza et al. | 15/351 X |

*Primary Examiner*—Mark Rosenbaum
*Assistant Examiner*—S. Thomas Hughes
*Attorney, Agent, or Firm*—Fay, Sharpe, Beall, Fagan, Minnich & McKee

[57] ABSTRACT

A snap-together vacuum cleaner housing comprises at least three discrete pieces which can be assembled and disassembled without the use of adhesive, fasteners, or tools. A lock ring comprises two semicircles of different radii. The lock ring encircles discrete portions of the housing and joins them together.

6 Claims, 5 Drawing Sheets

H
50
50
50
54
54
52
G
24

24

56
90
52
E
26
26
56
52

METHOD OF ASSEMBLING A VACUUM CLEANER

This application is a continuation of application Ser. No. 07/753,717 filed on Sep. 3, 1991, now abandoned, which in turn, is a division of application Ser. No. 07/464,202 filed on Jan. 12, 1990. The latter application has now issued into U.S. Pat. No. 5,093,956 dated Mar. 16, 1992.

BACKGROUND OF THE INVENTION

1. Field of the Invention

This invention pertains generally to housings for small appliances and more specifically to housings for vacuum cleaners.

2. Description of the Related Art

Typically, housings for small appliances, for example vacuum cleaners, have required some securing means to secure parts of the housing together. Typical securing means have been adhesives or fasteners such as screws.

These securing means have proven generally effective but certain areas of deficiency remain.

If the housing parts are glued together by way of adhesive, the housing cannot be easily disassembled without damaging it. Such disassembly is often necessary for maintenance.

Should another type of fastener be used, for example a screw, or bolt and nut, disassembly is possible. However, these loose pieces provide difficulties in manufacturing and assembling the product. Production costs rise due to the extra costs associated with manufacture and inventory of the fastener. Assembly of the vacuum cleaner is more time consuming and care must be taken that the correct fastener is used for each fastening location. Further, servicing such a housing is more difficult in that these fasteners are often misplaced during disassembly. The repairman must stock a variety of these fasteners to effectively service the wide variety of housings present in the small appliance industry.

The present invention contemplates a new and improved housing which is simple in design, effective in use, and overcomes the foregoing difficulties and others while providing better and more advantageous overall results.

SUMMARY OF THE INVENTION

In accordance with the present invention, a vacuum cleaner housing is provided which has at least three discrete pieces. The pieces are selectively assemblable to form the housing, with such assembly requiring no additional materials such as adhesive or fasteners.

In accordance with another aspect of the invention, the discrete pieces of the housing snap together to form the housing.

According to a further aspect of the invention, plurality of pairs of attaching means for attaching one discrete piece of the housing to another are provided. Each pair of attaching means comprises a first and second type element. The first type element is operatively associated with the second type element to selectively join together different discrete parts of the housing.

According to another aspect of the invention, the first type element comprises an elongated extension having a first and second end. The first end of the first type element is generally pointed. The second end of the first type element is fixedly attached to a piece of the housing. A portion of the extension between the first end and the second end is the widest portion of the extension.

According to another aspect of the invention, the elongated extension of the first type element has a ledge between the first and second end. The ledge is formed by a wedge-shaped protrusion from the side of the first end of the extension and is located at the widest portion of the extension. The ledge cooperates with a second type element to secure the first end of the first type element to a second type element, and thereby to join together different discrete parts of the housing.

According to another aspect of the invention, the vacuum cleaner is an upright type vacuum cleaner.

According to another aspect of the invention, the housing encloses an associated motor, dirt bag, and portion of an associated air path.

According to another aspect of the invention, the housing is assembled without adhesive, fasteners, or tools. Rather, such assembly is performed by a person's hands causing the discrete pieces of the housing to snap together.

According to a further aspect of the invention, the housing further comprises a lock ring. The lock ring is operative to encircle portions of at least three discrete pieces of the housing.

According to a further aspect of the invention, the lock ring has a bore therethrough. The lock ring is operative to selectively join together at least three discrete pieces of the housing by receiving portions of the discrete pieces of the housing through the bore.

According to another aspect of the invention, the bore comprises a first semicircle of a first radius and a second semicircle of a second radius. The first radius is less than the second radius.

According to a further aspect of the invention, the first radius is between 10% and 25% less than the second radius.

According to a further aspect of the invention, at least one of the discrete pieces of the housing encircled by the lock ring has a wall thickness. That portion of the discrete piece is in the form of an arc of a circle.

According to a further aspect of the invention, the wall thickness of the portion of the discrete piece of the housing which is encircled by the lock ring is substantially equal to the difference between the first radius and the second radius.

According to a further aspect of the invention, the portion of the discrete piece of the housing which is received within the bore of the lock ring, and the first semicircle, cooperate to selectively receive and associated motor shaft.

According to a further aspect of the invention, a collar is selectively received onto the associated motor shaft between the lock ring and the housing.

According to a further aspect of the invention, the lock ring further comprises a recess in the second semicircle. Also, a bump in the portion of one of the discrete pieces of the housing encircled by the lock ring is selectively receivable by the recess and thereby operative to secure the lock ring to the housing.

According to a still further aspect of the invention, a method of assembling a vacuum cleaner housing comprises the steps of gathering the discrete pieces of the housing together; positioning the pieces in their assembled position relative to each other; and snapping the discrete pieces together.

According to another aspect of the invention, a method of assembling a vacuum cleaner housing comprises the steps of gathering discrete pieces of the housing together; positioning the discrete pieces in their assembled position relative to each other; and, snapping the discrete pieces together.

According to a further aspect of the invention, a method of disassembling a vacuum cleaner housing comprises the steps of inserting a prying means into the seam between discrete portions of the housing; and, snapping apart the discrete pieces of the housing by applying separating force to the seam through the prying means.

One advantage of the present invention is the provision of a vacuum cleaner housing which can be snapped together without the need for adhesive, fasteners, or additional tools. This features lowers the cost of manufacture, assembly, and inventory.

Another advantage of the invention is that the housing may be selectively disassembled without damaging the housing. This feature is helpful for maintenance of the vacuum cleaner.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts; a preferred embodiment of which will be described in detail in this specification and illustrated in the accompanying drawings which form a part hereof and wherein.

DESCRIPTION OF THE PREFERRED EMBODIMENT

Figure 1:
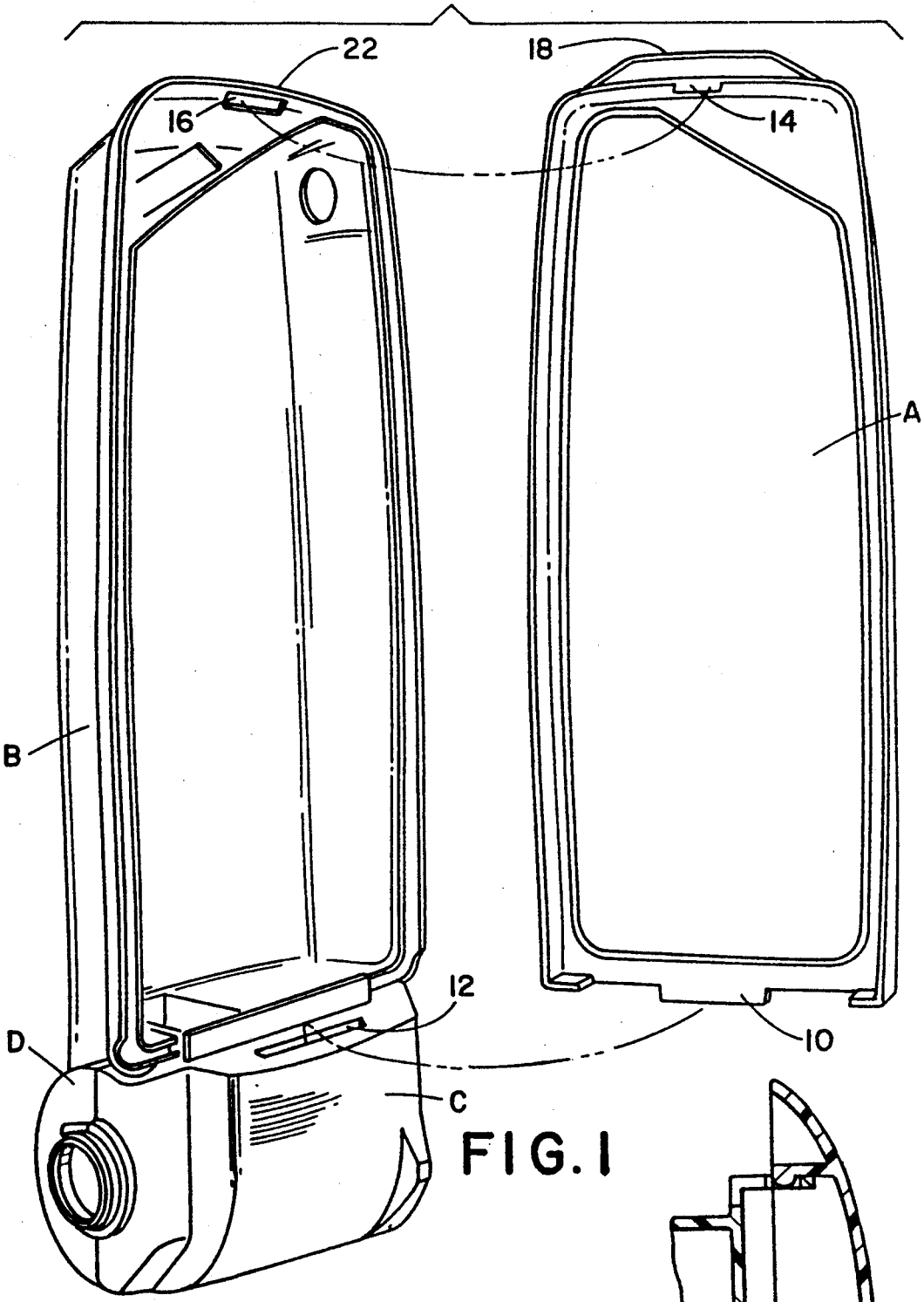
FIG. 1 is an exploded, perspective view of a vacuum cleaner housing according to the present invention.
Figure 2:
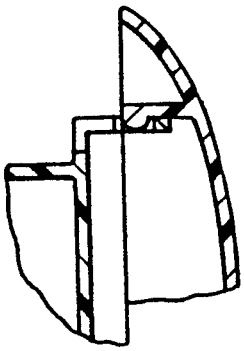
FIG. 2 is an enlarged, side cross-sectional assembled view of the fastening elements used to join the discrete parts of the housing of FIG. 1.

Referring now the drawings wherein the showings are for purposes of illustrating a preferred embodiment of the invention only and not for purposes of limiting same, FIG. 1 and FIG. 2 show a back housing B and a front panel A of a vacuum cleaner housing according to the present invention. The front panel A is selectively affixed to the back housing B by way of tabs 10, 14 and slots 12, 16. The front panel A is preferably made of a plastic material which is easily deformed by forces generated by a person's hands. To assemble front panel A to back housing B, tab 10 is inserted in slot 12. Next, tab 14 is aligned with slot 16. Pressure from the user's hands is applied at the top edge 18 of the front panel A. This pressure causes tab 14 it deflect enough to slide over the top edge 22 of the back housing B, and rest in slot 16. The procedure to remove the front panel A from the back housing B simply reverses the steps. Specifically, the top edge 18 of the front panel A is pulled away from the back housing B until tab 14 slides out of slot 16. In the preferred embodiment, this operation is necessary to change a filter and a dirt bag (not illustrated), which are located in the back housing B. Integrally molded as part of the back housing is a back motor shell half D which cooperates with a front motor shell half C.

Figure 3:
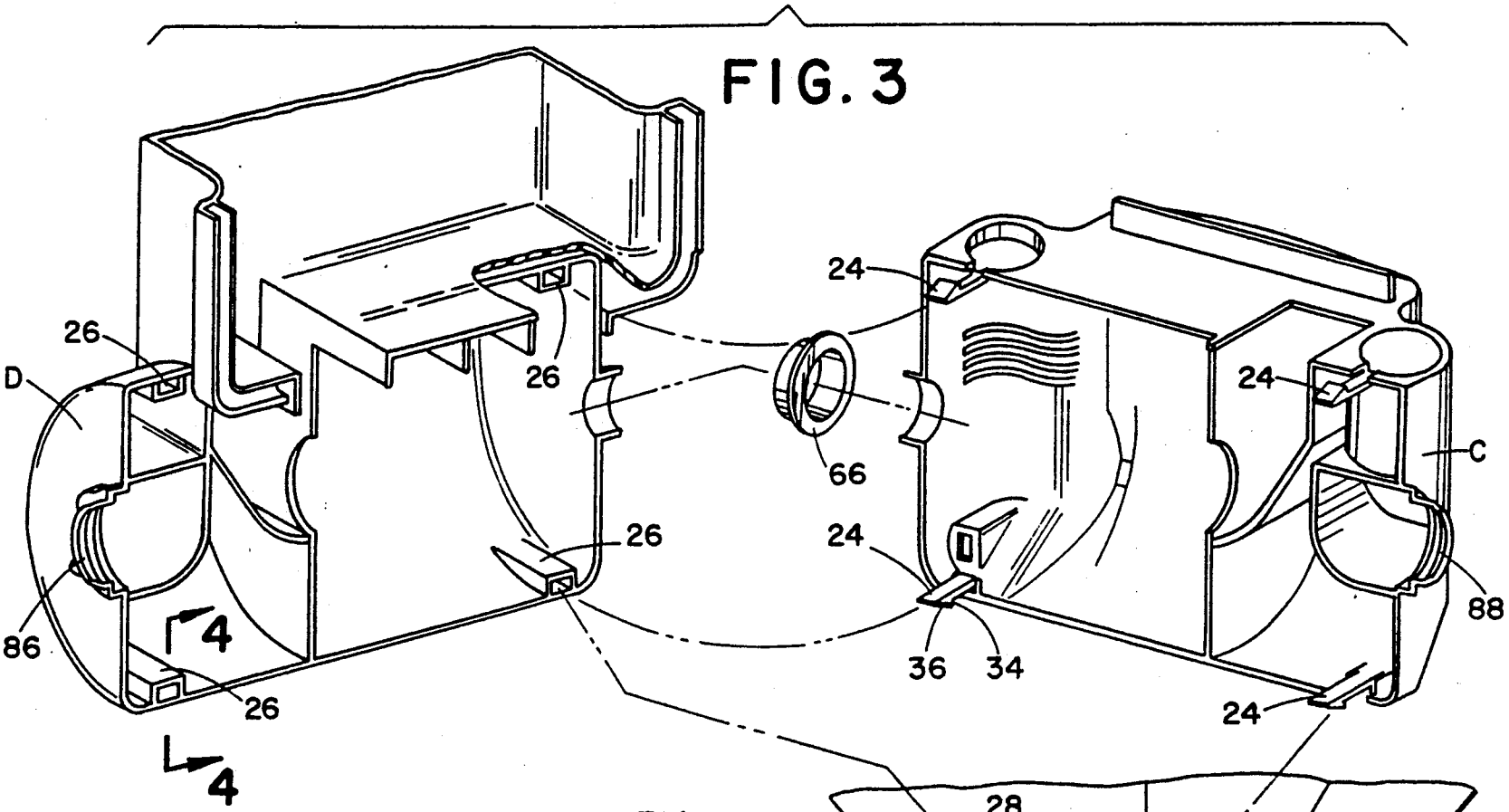
FIG. 3 is an exploded, perspective view of the front and back motor shell halves, two discrete parts of the vacuum cleaner housing and a collar.

With reference to FIG. 3, the motor shell halves C, D provide a housing for an associated electric motor (not illustrated) which drives the vacuum cleaner. The front motor shell half C snaps onto the back motor shell half D by way of fastening means 24, 26. A first type fastening element 24 comprises an elongated extension having a first end 28 and a second end 30. A ledge 34 is formed by a wedge-shaped protrusion 36 which protrudes from the side of the first end 28 of the first type 24 fastening element.

Figure 4:
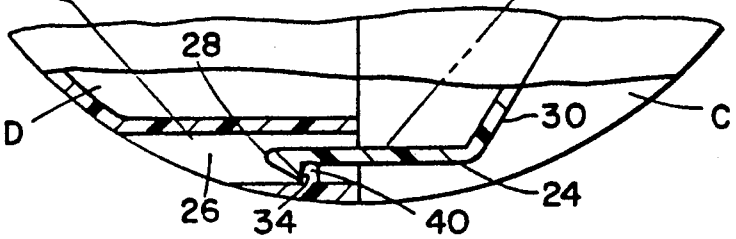
FIG. 4 is an enlarged, side, cross-sectional assembled view of FIG. 3 showing the operation of the fastening elements used to join the discrete parts of the housing shown in FIG. 3.

With continuing reference to FIG. 4, the second type fastening element 26 is characterized by a lip 40 which cooperates with the ledge 34 of the first type fastening element 28 to secure the first type fastening element 28 to the second type fastening element 30, and thereby, to secure the front motor shell half C to the back motor shell half D.

Figure 5:
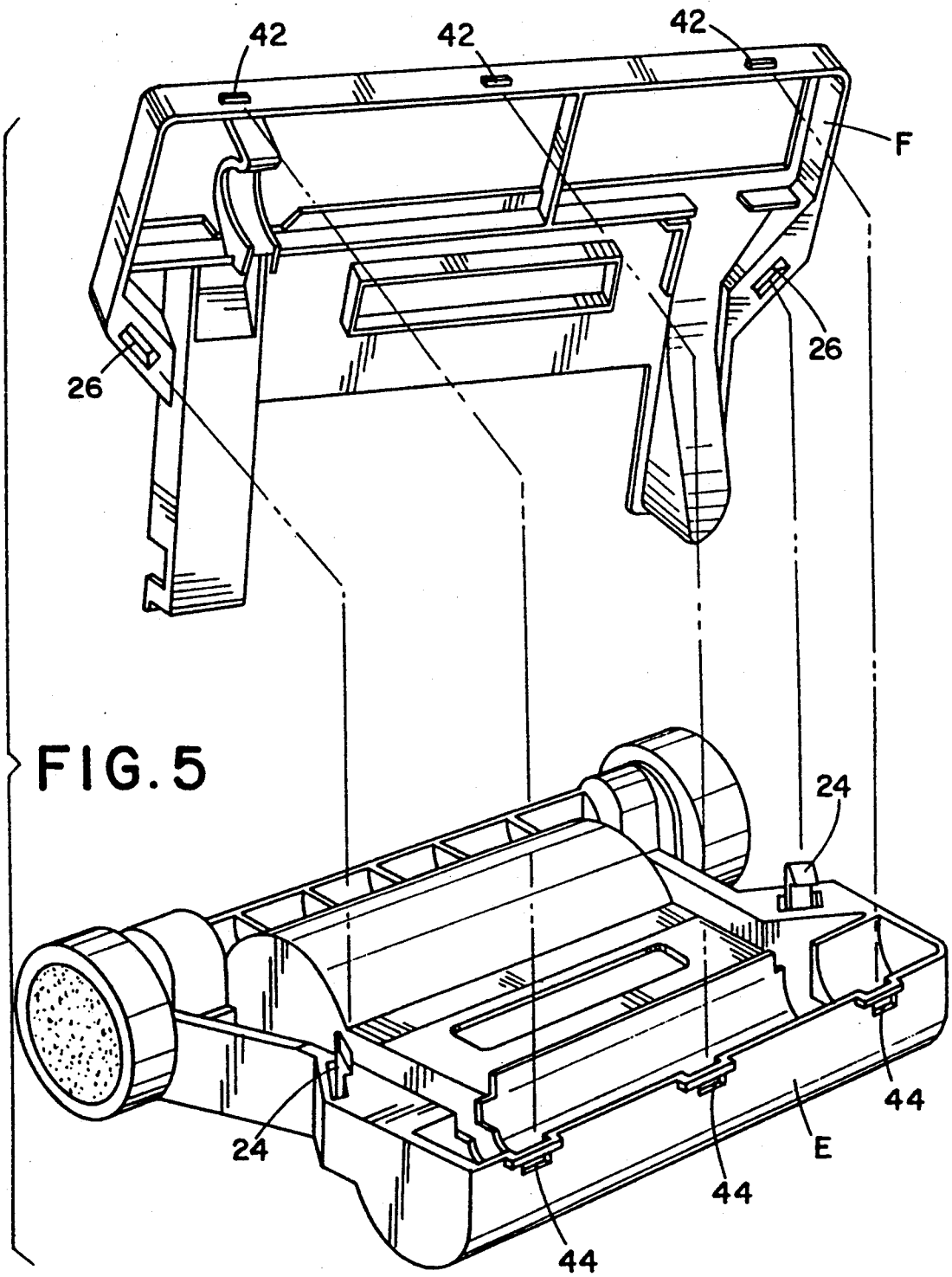
FIG. 5 is a exploded, perspective view, upside down, of the nozzle guard and the nozzle base, two discrete parts of the housing.

With reference to FIG. 5, the nozzle base E and the nozzle guard F are two additional discrete parts of the vacuum cleaner housing. FIG. 5 is viewed with the nozzle base E and the nozzle guard F being upside down in relation to their normal orientation and is being shown this way for purposes of illustration only. The nozzle guard F is snapped together with the nozzle base E by means of a pair of first type fastening elements 24 and a pair of second type fastening elements 26. Additionally, three tabs 42 across the front of the nozzle guard F cooperate with three slots 44 across the front of the nozzle base E. By way of the fastening elements 24, 26, 42, 44, the nozzle guard snaps onto the nozzle base without need for adhesive, other fasteners, or tools.

Figures 6, 7, 8, 9:
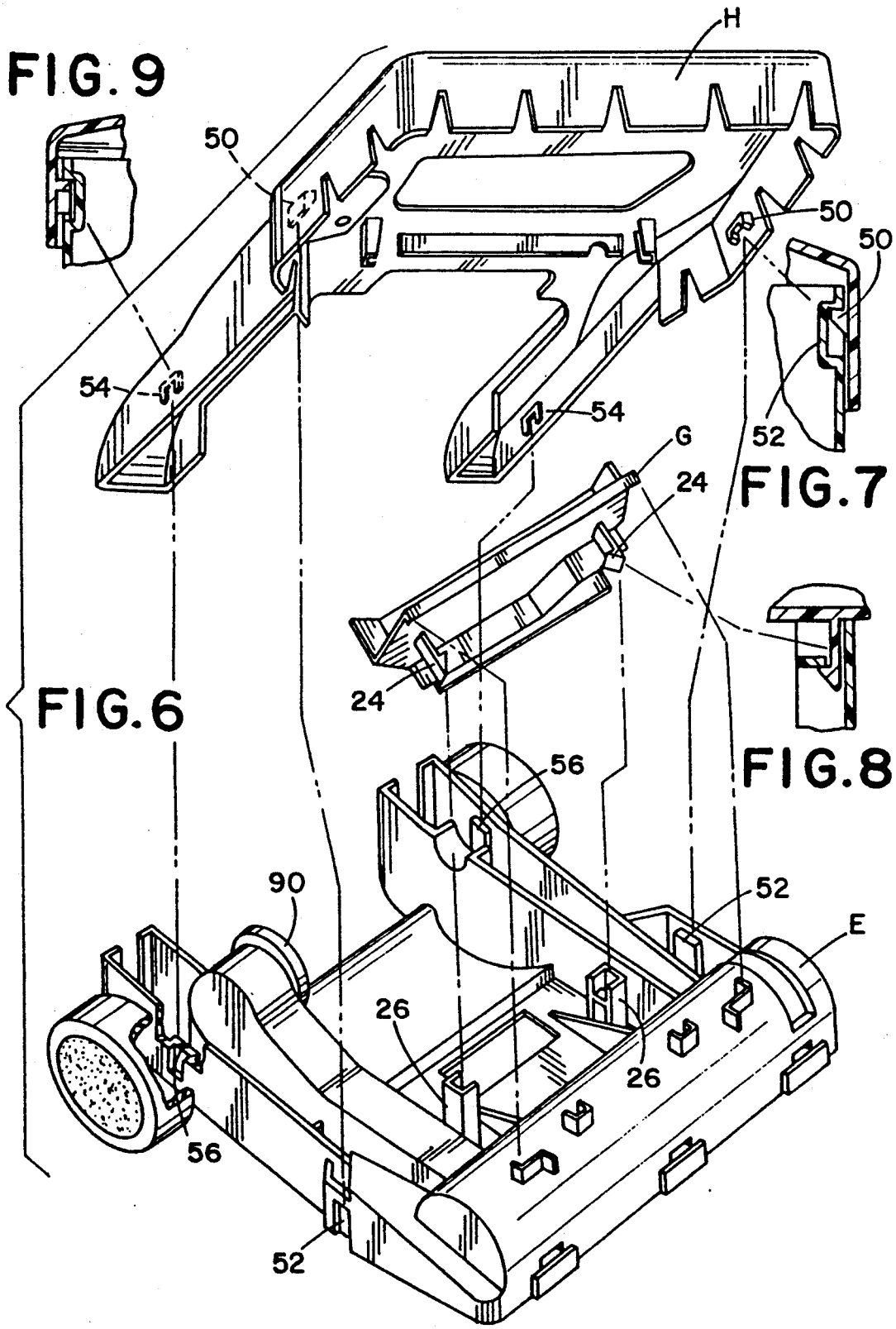
FIG. 6 is an exploded, perspective view of the nozzle base, light bracket, and nozzle cover which are three discrete parts of a housing according to the present invention.
FIG. 7 is an enlarged cross-sectional assembled view of an attaching means used to join the nozzle cover to the nozzle base.
FIG. 8 is a enlarged, cross-sectional assembled view of an attaching means used to join the light bracket to the nozzle base.
FIG. 9 is an enlarged, side, cross-sectional assembled view of an attaching means used to join the nozzle cover to the nozzle base.

With reference to FIG. 6, the assembly of a nozzle base E, a light bracket G, and a nozzle cover H is described. The light bracket G snaps onto the nozzle base E by means of fastening elements 24, 26. The operation of these fastening elements 24, 26 is also shown in FIG. 8. The nozzle cover H is snapped to the nozzle base E by way of fastener elements 50, 52, 54, and 56. Fastener 50 snaps into and is received by fastener 52. Fastener 54 is snapped into and received by fastener 56. The operation of fastener elements 50, 52 is detailed in FIG. 7 and the operation of fastener elements 54, 56 is detailed in FIG. 9.

Figure 11:
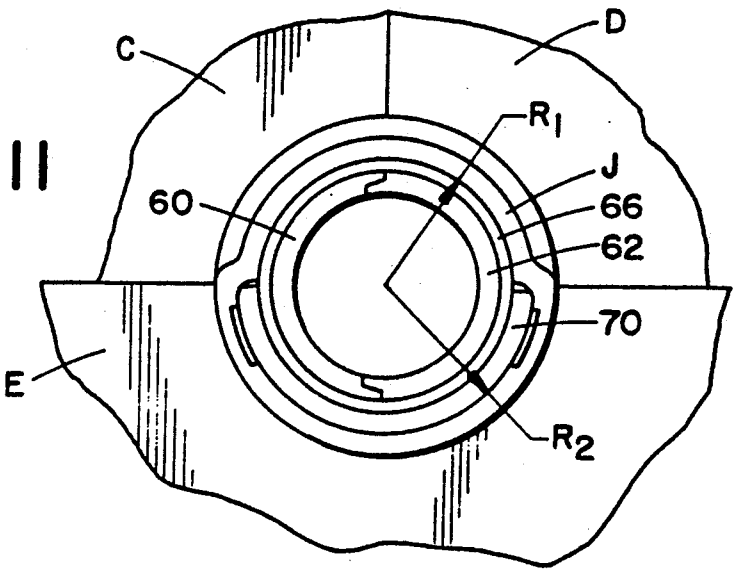
Figure 10:
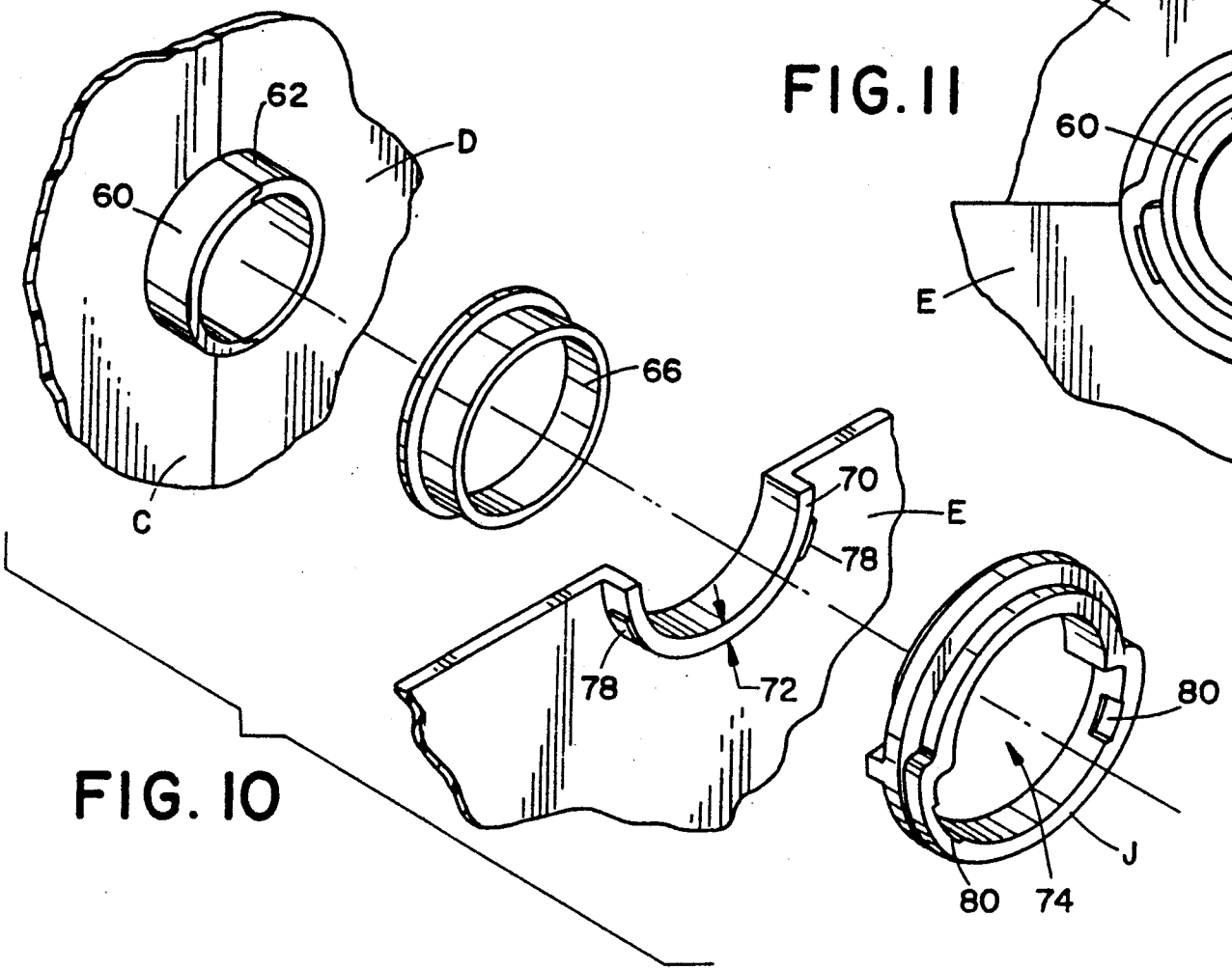
FIG. 10 is an exploded perspective view of the motor shell halves, the collar, the nozzle base, and the lock ring, and their inter-relation; and, FIG. 11 is a front, elevational assembled view of the lock ring, nozzle base, collar, and motor shell halves in assembled position.

With reference to FIG. 10 and FIG. 11, the operation of a lock ring J is illustrated. The front motor shell half C has an extension 60 in the form of a semicircular arc. Likewise, the back motor shell half D has a similar extension 62. When the front motor shell half C and the back motor shell half D are properly assembled, the extensions 60, 62 fit together to form a stub cylinder. A collar 66 made of a suitable lubricating material fits over the extensions 60, 62 and helps to secure them as well as lubricate the movement of the stub cylinder. The nozzle base E also has an extension 70 which is in the form of a semicircular arc. The extension 70 has a wall thickness 72.

The lock ring J has a bore 74 therethrough. The bore 74 is made up of two semicircles. The first semicircle is defined by a first radius R1 and the second semicircle is defined by a second radius R2. The first radius R1 is smaller than the second radius R2 by an amount equal to the wall thickness 72 of the extension 70 of the nozzle base E. This difference in bore radius allows the lock ring J to receive the extension 70 and secure the three discrete parts of the vacuum cleaner housing, namely the nozzle base E, the front motor shell half C and the back motor shell D, together. This construction allows the housing A to pivot on the nozzle base E.

The lock ring J is secured to the nozzle base E by way of bumps 78 and recesses 80. The lock ring J snaps into place as shown in FIG. 11 when the bumps 78 are received into the recesses 80. The dimensions of the bumps 78 and the recesses 80 are such that a slight press fit is obtained, thereby locking the lock ring J to the nozzle base E and thereby securing the front and back motor shell halves C, D, the collar 66, and the nozzle base E.

When fully assembled, the extensions 60, 62 of the front and back motor shell halves C, D receive an associated motor shaft end which extends therethrough.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Have thus described the invention, it is now claimed:

1. A method of assembling a vacuum cleaner housing, the method comprising the steps of:

providing a nozzle base, having wheels for movement over a floor surface and a suction opening, and a nozzle cover which is positioned above said nozzle base, wherein each of said base and cover comprise cooperating fastening elements which are of one piece with said base and cover, respectively;

positioning said base and cover adjacent each other;

advancing said base and cover toward each other;

manually elastically deforming said fastening elements of at least one of said base and cover as said base and cover are advanced toward each other;

snapping said fastening elements together to secure said cover to said base;

providing a nozzle guard which is positioned beneath said nozzle base, said nozzle guard and said nozzle base comprising cooperating fastening elements which are of one piece with said guard and base, respectively;

advancing said guard and base toward each other;

manually elastically deforming said fastening elements of at least one of said guard and base as said base and guard are advance toward each other; and, snapping said fastening elements together to secure said guard to said base.

2. A method of assembling a vacuum cleaner housing, the method comprising the steps of:

providing a first motor housing portion and a second motor housing portion which cooperate to enclose a motor, wherein said first and second motor housing portions each comprise a mating surface and a fastening element which is of one piece with said first and second motor housing portions respectively;

positioning said first and second motor housing portions adjacent each other;

advancing said first and second motor housing portions toward each other;

manually elastically deforming said fastening elements of at least one of said first and second motor housing portions as said first and second motor housing portions are advanced toward each other;

snapping said fastening elements together as said mating surfaces contact each other to form a complete motor housing wherein said first and second motor housing portions when secured to each other provide an annular extension;

providing a nozzle base for supporting said motor housing;

positioning said motor housing on said nozzle base;

providing a lock ring;

providing an extension on said nozzle base;

providing said annular extension of said motor housing onto said nozzle base extension; and, snapping said lock ring onto said annular extension of said first and second motor housing portions and said nozzle base extension to secure them together.

3. The method of claim 2 further comprising the steps of:

providing a light bracket which overlies said nozzle base, said light bracket and said nozzle base comprising cooperating fastening elements which are of one piece with said bracket and base, respectively;

advancing said bracket and base toward each other;

manually elastically deforming said fastening elements of at least one of said bracket and base as said base and bracket are advanced toward each other; and, snapping said fastening elements together to secure said bracket to said base.

4. The method of claim 3 wherein said step of snapping said fastening elements to secure said bracket to said base is accomplished before said step of providing said nozzle cover.

5. A method of replacing an associated dirt bag within a vacuum cleaner housing, the method comprising:

providing a vacuum cleaner housing selectively containing a dirt bag and comprising at least first and second discrete housing members, said first housing member having a first mating surface and first assembly means, which is of one piece with said first housing member, for selectively securing said first and second housing members into a housing, said second housing member having a second mating surface and a second assembly means, which is of one piece with said second housing member, for selectively securing said first and second housing members into a housing, said first assembly means comprising a first tab at a first end of said first housing member and a second tab at a second end of said first housing member, said second assembly means comprising a first slot at a first end of said second housing member and a second slot at a second end of said second housing member;

manually elastically deflecting a top edge of said first housing member away from said second housing member until said second tab is displaced from said second slot;

distancing said first housing member from said second housing member;

removing a full dirt bag;

installing an empty dirt bag;

inserting said first tab of said first housing member into said first slot in said second housing member;

advancing said second tab of said first housing member toward said second slot of said second housing member; and, manually elastically deflecting said top edge of said first housing member so that said second tab is received into said second slot.

6. The method of claim 5 wherein said second mating surface of said second housing member comprises a channel extending about a periphery of said second housing member wherein said method further comprises, before said step of manually elastically deflecting said top edge of first housing member, the steps of:

advancing said first and second housing members toward each other;

inserting said first mating surface of said first housing member into said channel of said second housing member;

advancing said second tab of said first housing member toward said second slot of said second housing member; and, manually elastically deflecting said top edge of said first housing member so that said second tab is received into said second slot.

* * * * *

UNITED STATES PATENT AND TRADEMARK OFFICE

CERTIFICATE OF CORRECTION

PATENT NO. : 5,283,939

DATED : February 8, 1994

INVENTOR(S) : Craig M. Saunders, et al.

It is certified that error appears in the above-indentified patent and that said Letters Patent is hereby corrected as shown below:

Claim 2, column 6, line 34, delete "providing" and substitute therefor --placing--.

Signed and Sealed this

Twenty-first Day of June, 1994

*Attest:*

Bruce Lehman

BRUCE LEHMAN

*Attesting Officer*

*Commissioner of Patents and Trademarks*